United States Patent [19]

Dawidowicz et al.

[11] 4,245,388

[45] Jan. 20, 1981

[54] SAFETY RAZOR

[76] Inventors: Jan Dawidowicz, 10 Valley La., Fairfield, Conn. 06432; John D. Watts, 2 Mohawk Dr., Clinton, Conn. 06413

[21] Appl. No.: 862,004

[22] Filed: Dec. 19, 1977

[51] Int. Cl.[3] ..... B26B 21/54

[52] U.S. Cl. ..... 30/47

[58] Field of Search ..... 30/47, 77, 84, 32

[56] References Cited

U.S. PATENT DOCUMENTS

| | | | |
|---|---|---|---|
| 2,237,676 | 4/1941 | Lewis | 30/77 X |
| 2,799,927 | 7/1957 | Beham | 30/47 X |
| 3,777,396 | 12/1973 | Simonetti | 30/47 |
| 3,815,233 | 6/1974 | Carroll | 30/47 |

FOREIGN PATENT DOCUMENTS

| | | | |
|---|---|---|---|
| 2332333 | 3/1974 | Fed. Rep. of Germany | 30/47 |
| 1444545 | 8/1976 | United Kingdom | 30/47 |

*Primary Examiner*—Jimmy C. Peters

[57] ABSTRACT

The specific disclosure provides a safety razor comprising a cap member having a planar skin abutting upper surface defining a first plane for guiding the shaver over skin surfaces while shaving. A blade has a cutting edge at one end thereof in a second plane and extends from beneath the cap member. The first and second planes intersect at an angle of between about 15° to about 25°. A blade seat member is located beneath the blade and has a blade seat surface in contact with the blade and a plurality of spaced elements extending outwardly from beneath the cutting edge.

14 Claims, 12 Drawing Figures

FIG. 3
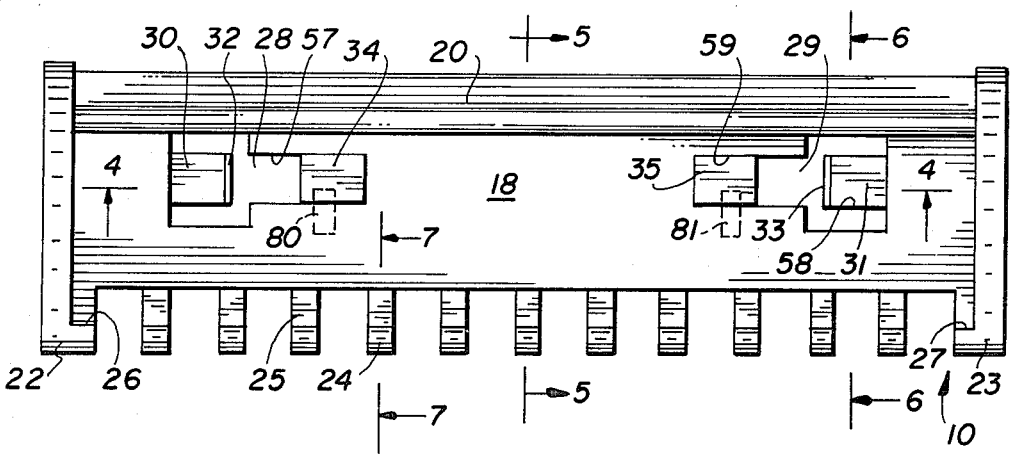
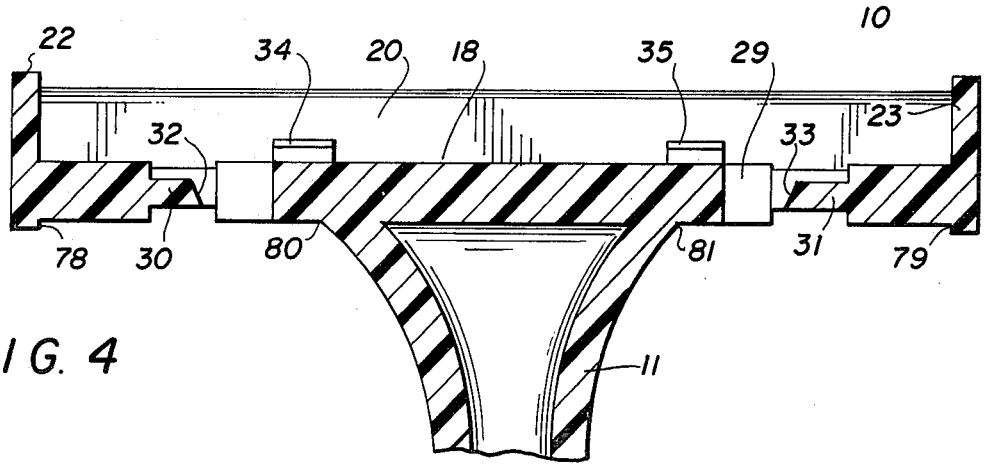
FIG. 4
FIG. 5
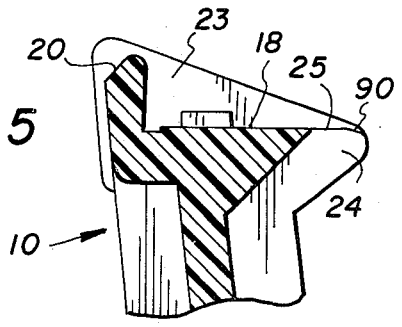
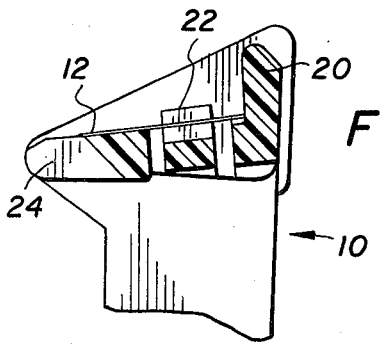
FIG. 6

SAFETY RAZOR

BACKGROUND OF THE INVENTION

1. Field of the Invention

The present invention relates to safety razors. More particularly, the present invention relates to safety razors particularly suitable for general body use.

2. DESCRIPTION OF THE PRIOR ART

As used herein "body" means skin surfaces other than the face. Safety razors used for body shaving, such as by women or for surgical preparation, are generally structured in the same manner as safety razors designed for facial use by males. However, facial skin that is frequently shaved with a safety razor is toughened by a daily scraping of epidermis, whereas body shaving with facial razors by women and obviously surgical preparation shaving are performed relatively infrequently, and therefore produce a high number of nicks and cuts. Further, facial shaving does not require an awkward physical position such as required during under-arm or leg shaving.

Commercially available facial safety razors have a guard surface situated outwardly and downwardly from the cutting edge of the blade or blades. The guard surface may be of the comb variety or an elongated bar. The cutting edge is guided along the skin by the guard surface and the leading edge of the cap or top of the razor. The razor handle is positioned with respect to the razor head to facilitate skin contact by the guard surface and the leading edge of the cap. Further, the cutting edge of facial safety razors extends a slight distance outwardly from a plane extending from the leading edge of the cap tangent to the guard surface to have, as is known in the safety razor art, a positive exposure.

SUMMARY OF THE INVENTION

In accordance with the present invention, there is provided a safety razor comprising a cap member having a planar skin abutting upper surface for guiding the razor over skin surfaces. A blade has a cutting edge at one end thereof which extends forwardly from beneath the cap member. The upper cap surface and the cutting edge define planes that intersect at an angle of about 15° to about 25°. A blade seat member is located beneath the blade and includes means which extend forwardly from beneath the cutting edge for guarding skin surfaces from the cutting edge. Thus, this aspect of the invention provides a relatively large planar surface to orient the blade cutting edge with respect to skin surfaces and to guide the razor. Such a large guide surface simplifies the proper orientation of the razor particularly when used in an awkward position or when used on skin surfaces not visible to the user. Further, such simplified orientation of the razor is also most helpful during surgical preparation when the user obviously can not feel the shaver.

In accordance with another aspect of the present invention, the blade cutting edge has a negative exposure, i.e. it is located rearwardly of a plane extending from the forward edge of the cap upper surface tangent to the skin guarding means. In accordance with a further aspect of the present invention, the skin guarding means is in contact, at spaced intervals with the blade cutting edge. These latter aspects provide a particularly safe razor for general body use and also for facial use by one whose facial skin has imperfections such as acne.

BRIEF DESCRIPTION OF THE DRAWINGS

FIG. 3 is a top view of the blade seat member;

FIG. 4 is a sectional view of the blade seat member taken along line 4—4 of FIG. 3;

FIG. 5 is a sectional view of the blade seat member taken along line 5—5 of FIG. 3;

FIG. 6 is a sectional view of the blade seat member taken along lines 6—6 of FIG. 3;

DESCRIPTION OF SPECIFIC EMBODIMENTS

Figure 1:
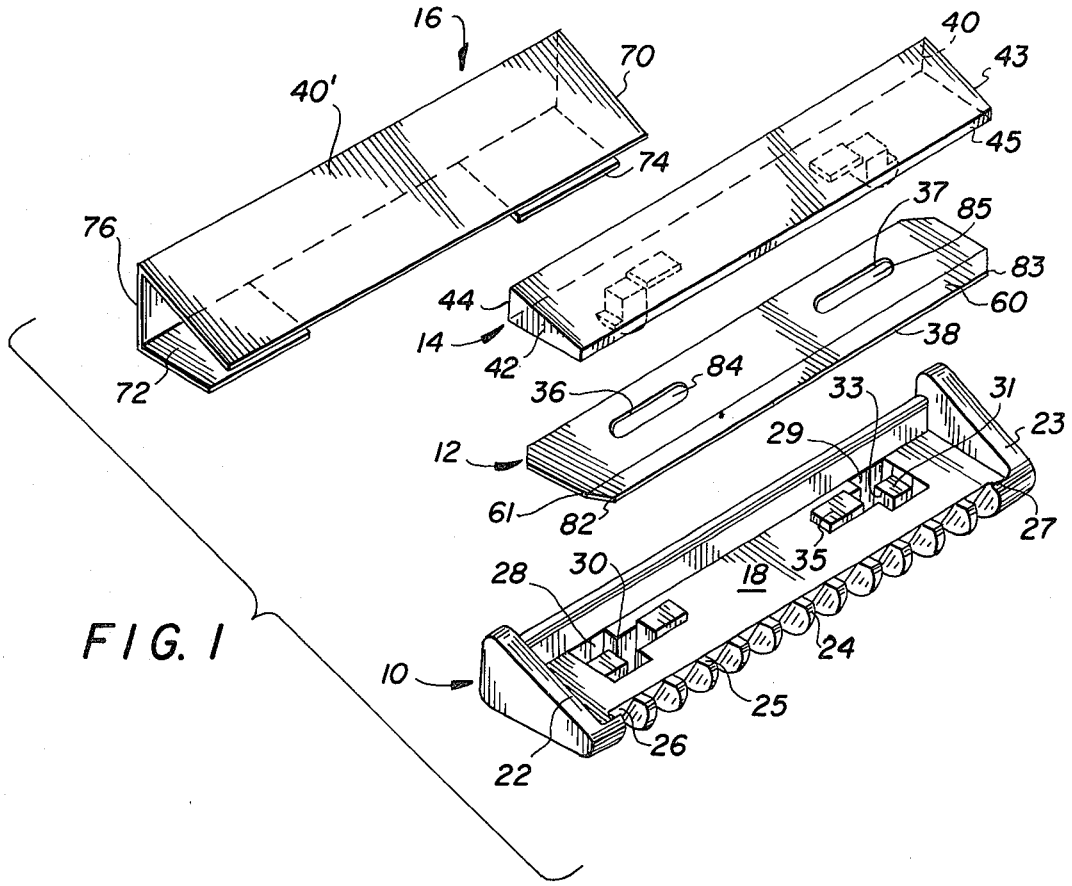
FIG. 1 is an exploded view of two razor head embodiments of the present invention.
Figure 2:
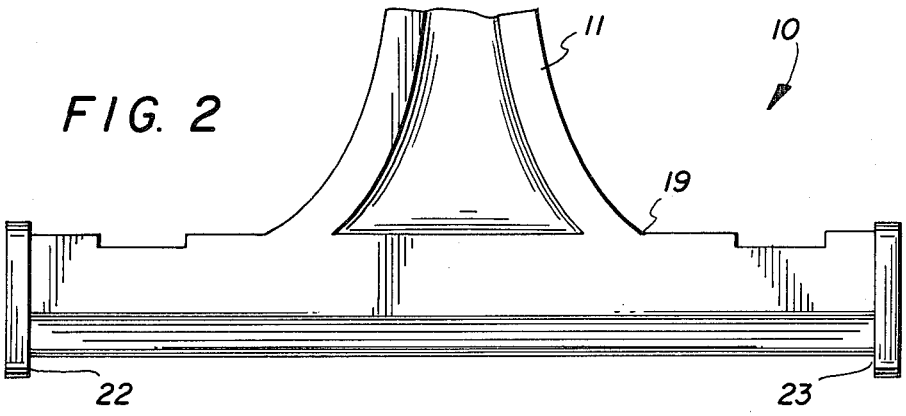
FIG. 2 is a rear view of a blade seat member.

FIG. 1 shows in an exploded view the head portion of a razor having a blade seat member 10, a blade 12 and a cap member 14 which are interconnected as hereinafter described to form one embodiment of the present invention. FIG. 1 also includes another cap member 16 which is combined as hereinafter described with the blade seat member 10 and the blade 12 to form another embodiment of the present invention. As shown in FIGS. 2 and 4, a handle 11 extends downwardly from the underside 19 of the blade seat member 10.

Figure 7:
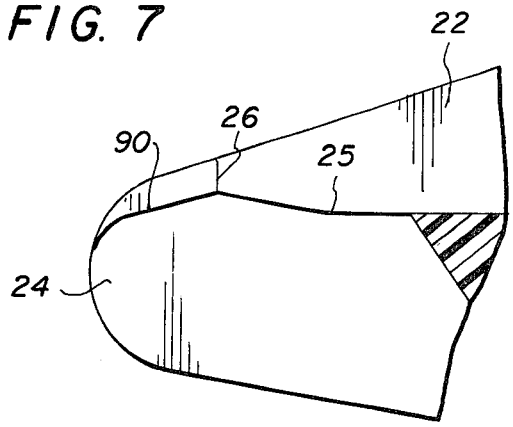
FIG. 7 is a sectional view of the blade seat member taken along lines 7—7 of FIG. 3.
Figure 8:
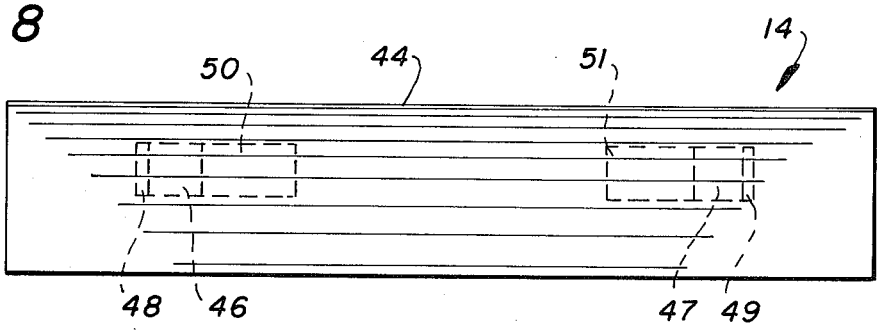
FIG. 8 is a top view of a cap member.
Figure 9:
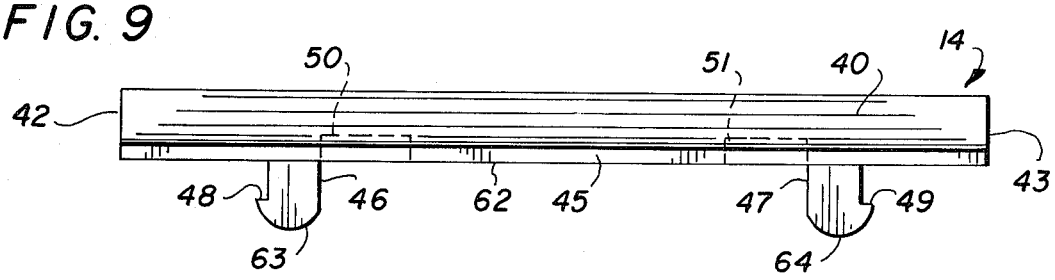
FIG. 9 is a front view of the cap member.
Figure 10:
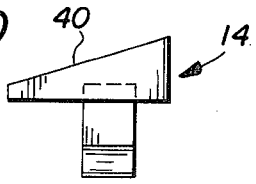
FIG. 10 is a side view of the cap member.

With reference to FIGS. 1 through 6, the blade seat member 10 has a blade seat surface 18, and an upwardly extending rear wall 20 between a pair of spaced shoulders 22, 23. Skin guarding means in the form of a plurality of teeth-like members 24 extend forwardly from the blade seat member 10, and a pair of spaced stop portions 26, 27 extend inwardly from the shoulders 22, 23. As shown in FIG. 7, each one of the teeth 24 has a ramp 25 extending upwardly and outwardly. The stop portions 26, 27 are at right angles to the blade seat surface 18. A pair of perforations 28, 29 are formed downwardly through the blade seat member 10. A tab 30, 31 extends inwardly into each of the perforations 28, 29. As shown in FIG. 4, the tabs 30, 31 are spaced downwardly from the blade seat 18 and upwardly from the underside 19 of the blade seat member 10, and each tab 30, 31 at its inner end has a downwardly and inwardly extending sloped surface 32, 33. As shown in FIGS. 1 and 3, each perforation 30, 31 has a pair of opposing wall surfaces 56, 57; 58, 59 spaced inwardly from a respective tab 30, 31. Each pair of wall surfaces 56, 57; 58, 59 are spaced apart a distance equal to the vertical dimension shown in FIG. 3 of the tabs 30, 31. Formed inwardly of each of the pair of wall surfaces 56, 57; 58, 59 is a rectangular upwardly extending element 34, 35 having a fore and aft dimension equal to the distance between each pair of wall surfaces 56, 57; 58, 59.

With reference to FIG. 1, the blade 12 is a commercially available single edge injector-type razor blade having a cutting edge 38 and a pair of spaced transversely elongated perforations 36, 37. As well known in the art, the cutting edge 38 is formed by a pair of converging beveled surfaces 60, 61.

As shown in FIGS. 6 and 7, the blade 12 is positioned on the blade seat surface 18 between the shoulders 22, 23 and the rear wall 20 with the outer front corners of the blade 12 behind the stop portions 26, 27 and with the bottom beveled surface 61 of the cutting edge 36 resting on the ramp 25 of the teeth 24 such that the cutting edge is in contact with each tooth 24. The rectangular elements 34, 35 of the blade seat member 10 extend through the blade perforations 36, 37 to minimize fore and aft relative movement between the blade 12 and the blade seat member 10.

Figure 11:
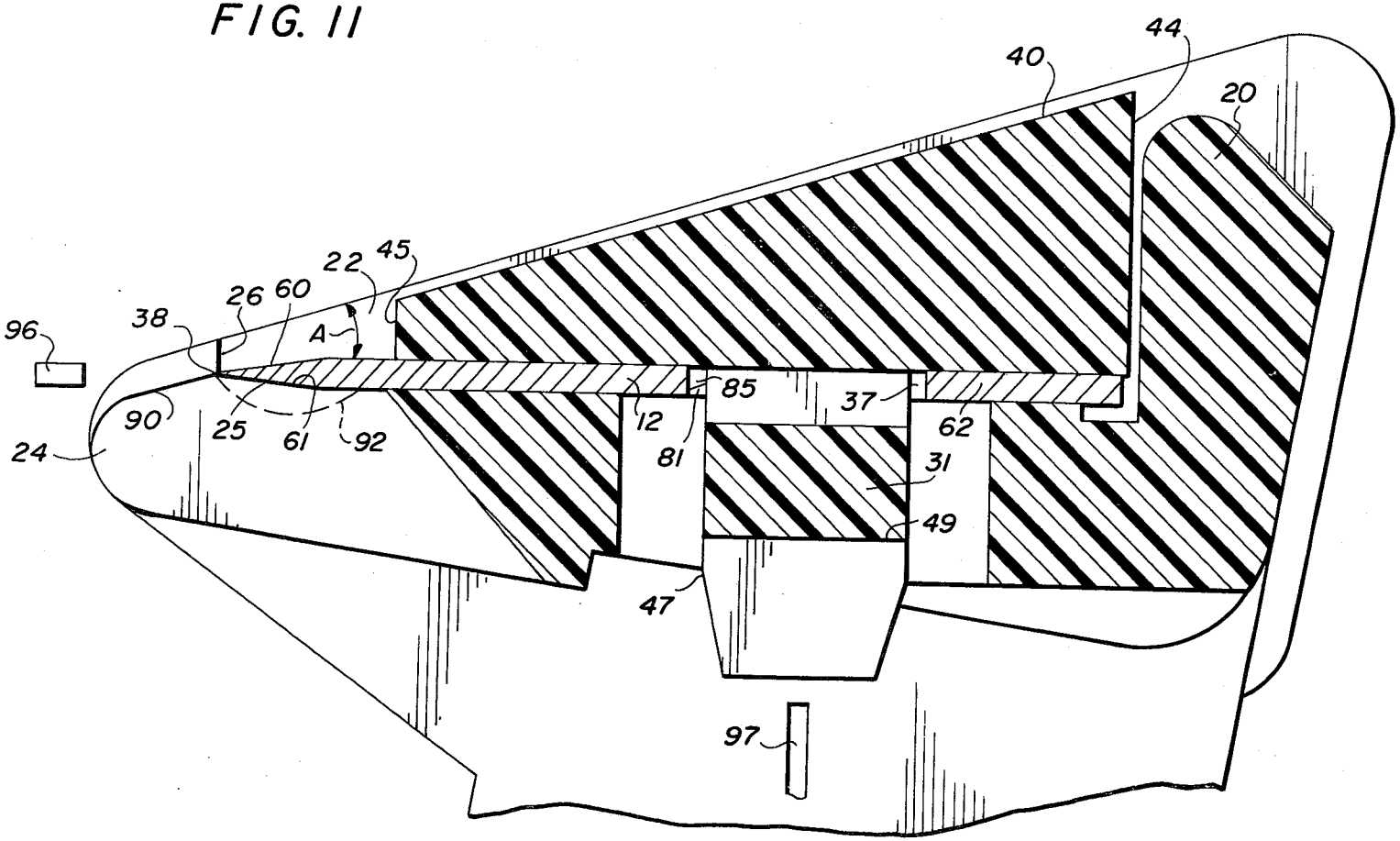
FIG. 11 is an assembled sectional view along line 6—6 of FIG. 3 of the blade seat member and blade with a cap member connected thereto.
Figure 12:
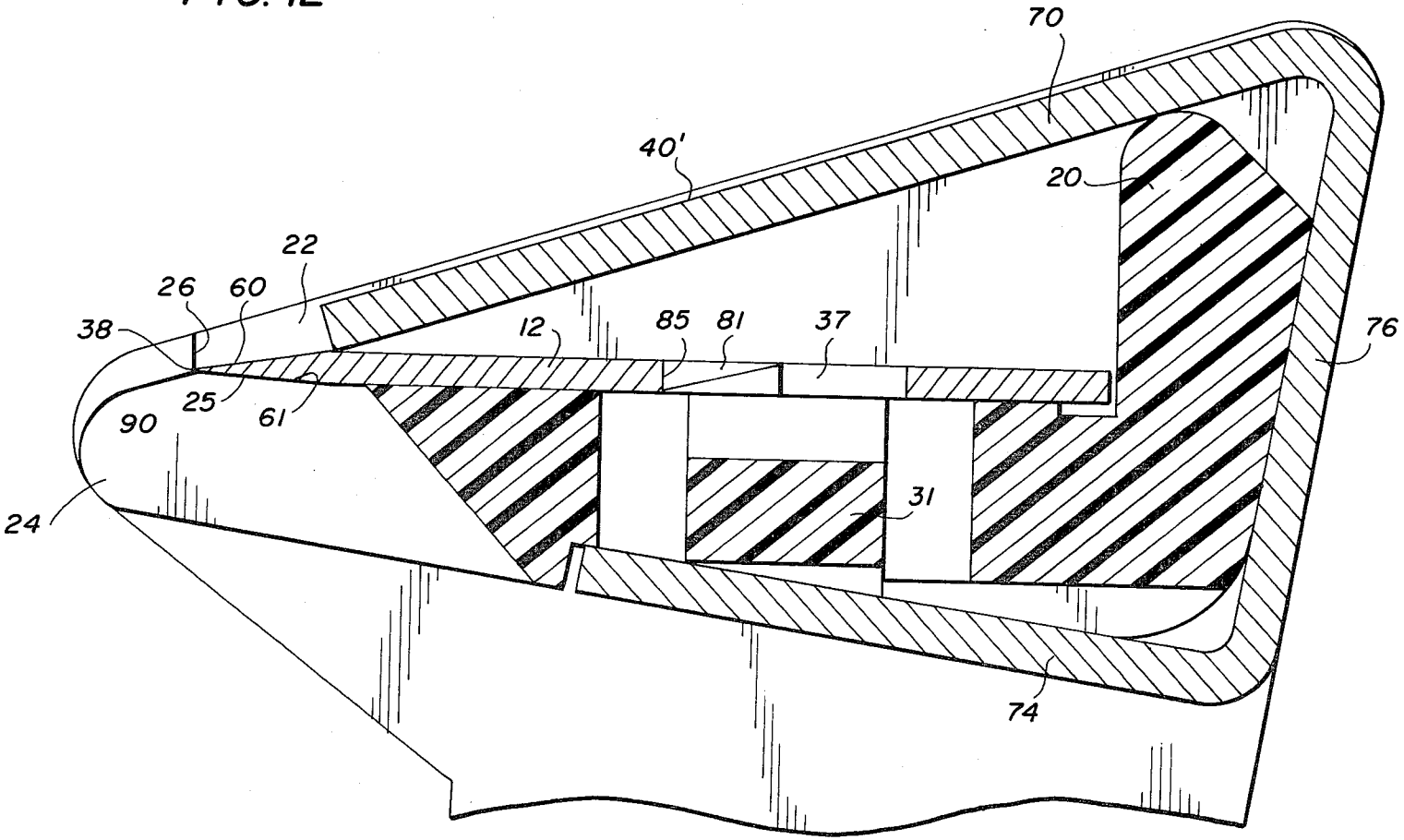
FIG. 12 is an assembled view along line 6—6 of FIG. 3 with another cap connected thereto.

In an alternative embodiment, the rectangular elements 34, 35 are replaced by upwardly and rearwardly sloped elements 80, 81 shown in FIGS. 11 and 12 and in dashed lines in FIG. 3. In this embodiment, the outer ends 82, 83 of the blade 12 are in abutting engagement with the stop portions 26, 27 and the forward surfaces 84, 85 are embedded in the sloped elements 80, 81 to prevent fore and aft movement.

With reference to FIGS. 1, and 8 through 10, the cap member 14 has a downwardly and forwardly extending top surface 40, outer side walls 42, 43, a rear wall 44, a front wall 45 and an underside 62. A pair of spaced posts 46, 47 extending downwardly from the underside 62. The bottom portion 63, 64 of each post 46, 47 is curved with the outer end forming a lip 48, 49. A pair of spaced rectangular recesses 50, 51 are formed in the cap underside 62 and adjacent to the posts 46, 47.

The cap member 14 is positioned on the blade 12 and blade seat member 10 combination shown in FIG. 6 with posts 46, 47 extending through the blade perforations 36, 37 and into the blade seat perforations 28, 29 with the curved portion 63, 64 near the lips 48, 49 of each post 46, 47 resting on its respective tab sloped surface 32, 33. The blade seat member 10 and the cap member 14 are firmly held together and the tabs 30, 31 are forced upwardly to snap lock the undersides of the tabs 30, 31 on the lips 48, 49 and thereby lock the cap member 14 to the blade seat member 10 with the blade 12 firmly bonded therebetween as shown in FIG. 11. When the razor head is assembled, the cap rear wall 44 is in juxtaposition with the rear wall 20 of the blade seat member 10 and the cap side walls 42, 43 are in close proximity to the shoulders 22, 23. Further, the blade seat rectangular recesses 50, 51, and the forward and rear surfaces 52, 53; 54, 50 of the posts 46, 47 are fitted between the opposing forward and rear walls 56, 57; 58, 59 in the blade seat perforations 28, 29 to prevent fore and aft relative movement between the cap member 14 and the blade seat member 10.

In the embodiment wherein the sloped elements 80, 81 replace the rectangular elements 34, 35, the cap rectangular recesses 50, 51 are not needed.

With reference to FIGS. 1 and 12, the cap member 14 is formed of metal such as 0.15 inch hard rolled stamped aluminum and has a forwardly and downwardly extending top member 70, a pair of spaced forwardly extending bottom members 72, 74 and a rear portion 76 between the top member 70 and the bottom members 72, 74. The cap member 14 is formed such that the top member 70 and the bottom members 72, 74 are in relatively close proximity to each other. The top member 70 is fitted to the blade 12 and blade seat member 10 combination of FIG. 6 by prying the top member 70 and the bottom members 72, 74 apart, and fitting the cap member 14 to the blade seat member 10 from the rear such that rear portion 76 abuts the rear of the blade seat rear wall 20 and the top member 70 is applying pressure against the top of the blade 12 and the bottom members 72, 74 are applying pressure against the underside 19 of the blade seat member 10 as shown in FIG. 12 to bond the blade 12 between the cap member 14 and the blade seat member 10. With reference to FIG. 4, when thus seated each of the bottom members 72, 74 extend between the wall surface 78, 79 and the point 80, 81 on the underside 19 of the blade seat member 10 where the handle 11 begins.

As shown in FIGS. 11 and 12, the top surface 40, 40' of each of the cap members 14, 16 are planar and the teeth-like members 18 have an upper forward flat surface 90 which are in a plane parallel to the planes defined by the cap upper surfaces 40, 70. The cutting edge 30 is rearward of a plane extending from the forward leading edge of the cap members 14, 16 tangent to the teeth-like members 18 to provide a negative exposure. Such structure permits cutting edge 38 to contact skin surfaces between the teeth-like members 18 only when the top or upper surfaces 40, 40' are in contact with the skin. If the razor head is slightly rotated clockwise as viewed in FIGS. 11 and 12, the cutting edge 38 is removed from the skin surface.

The blade 12 is in a plane which intersects the plane defined by the top surfaces 40, 40' at an angle (FIG. 11, angle A) of about 15° to about 25° and preferably at 18°. Suitable dimensions for the razor of the present invention are shown in the Figs. The blade seat member 10 can have a cut-out portion 92 (shown in dashed lines in FIG. 11) to facilitate cleaning the razor head.

In each of the foregoing embodiments the handle is formed with respect to the top surface 40, 40' of the cap member 14, 16 at an angle of about 50° to about 65°, and preferably at about 60° to facilitate maintaining the top surface 40, 40' in contact with skin surfaces during shaving. As used herein, if the handle 11 is curved, such angle will be defined by an axis extending transverse of the palm of a user and the top surface 40, 40'.

It is apparent that the above description of assembling the cap member 14, the blade 12 and the blade seat member 10 can be modified to first fit the blade to the cap member 14, and then fit the blade seat member 10 to the cap member 14.

In the above embodiments, the blade seat member 10 and the handle are integrally formed of plastic. However, the present invention also contemplates that the blade seat member 10 can be releasable secured to the handle 11 such that the head of the shaver may be replaceable. The cap member 14 is formed of plastic.

As used herein, with respect to the top surface 40, 40' of the cap members 14, 16, "planar" contemplates that the top surface 40, 40' may have recesses or raised surface portions which will not interfere with the remaining planar surface contacting skin surfaces.

The above-described razor embodiments are particularly suitable for general body use. Such embodiments can be modified for facial use by lowering the teeth-like members to provide a positive exposure for the cutting edge.

As shown in FIG. 11, the razor head can be assembled by placing the blade 12 on the blade seat surface 18, drawing the blade forward by a magnet 96 against the stop surfaces 26, 27 and forcing the blade down on the sloped elements 80, 81 to imbed the rear surfaces 84, 85 of the blade perforations 36, 37 in the sloped elements. Thereafter, the cap 14 is placed on the blade 12 with the posts extending through the blade and blade seat perforations 28, 29; 36, 37. The tabs 30, 31 are then deformed upwardly by fingers 97 to snap-lock the undersides of the tabs 30, 31 on the lips 48, 49.

What is claimed is:

1. A safety razor comprising:

a cap member having a planar skin abutting upper surface for guiding said razor over skin surfaces, said cap upper surface defining a first plane;

a blade having a cutting edge at one end thereof in a second plane, said cutting edge extending forwardly from beneath said cap member;

said first and second planes intersecting at an angle of about 15° to about 25°; and a blade seat member located beneath said blade and including means extending forwardly from beneath said cutting edge for guarding skin surfaces from said cutting edge;

said skin guarding means being oriented with respect to said cap upper surface to permit said cutting edge to contact skin surfaces only when said cap upper surface is in contact with such skin surfaces, and said skin guarding means being in contact, at spaced intervals, with said cutting edge.

2. The razor of claim 1 wherein said angle is about 18°.

3. The razor of claim 1 wherein said cutting edge is located rearwardly of a plane extending from the forward end of said cap upper surface tangent to said skin guarding means.

4. The razor of claim 1 wherein said skin guarding means comprises a plurality of spaced forwardly extending elements.

5. The razor of claim 4 wherein each one of said elements is in contact with said cutting edge.

6. The razor of claim 4 wherein said cutting edge is formed by an upper and lower converging surface, and wherein each of said elements has an upwardly sloped ramp surface in abutting engagement with said lower surface forming said cutting edge.

7. The razor of claim 4 wherein each one of said elements has a surface extending outwardly and downwardly in a plane parallel to said first plane.

8. The razor of claim 7 wherein said elements are oriented with respect to said cap upper surface to prevent said cutting edge from contacting skin surfaces when said cap upper surface is out of contact with such skin surfaces.

9. The razor of claim 1 wherein said blade seat member includes a plurality of downwardly extending perforations, and a tab member extending into each of said blade seat perforations; and wherein said cap member includes a plurality of posts extending downwardly through said blade seat perforations, each of said posts having an outwardly extending lip surface, said posts having a vertical dimension to prevent said lip surfaces from engaging the undersides of said tab members when said cap members is located on said blade, and said tab members being upwardly deformed to seat the undersides thereof on said lip portions.

10. The razor of claim 9 wherein said blade is perforated, and wherein said posts extend downwardly through said perforated blade.

11. The razor of claim 1 wherein said blade seat member includes a pair of spaced stop surfaces and a plurality of upwardly and rearwardly sloped elements, wherein the outer ends of said cutting edge are in abutting engagement with said stop surfaces, and wherein said blade includes rearwardly facing portions imbedded in said sloped elements to prevent rearward movement of said blade.

12. The razor of claim 1 wherein said cap member is integrally formed of metal and comprises a forwardly and downwardly biased top member in abutting engagement with the upper surface of said blade, a pair of spaced forwardly extending and upwardly biased bottom members in abutting engagement with the underside of said blade seat member, and a rear portion interconnecting said top member and said pair of bottom members.

13. The razor of claim 1 further comprising an elongated handle extending downwardly from said blade seat member, said handle being oriented with respect to said upper cap surface to facilitate maintaining said upper cap surface in contact with skin surfaces.

14. A safety razor comprising:

a cap member having a planar skin abutting upper surface for guiding said razor over skin surfaces, said cap upper surface defining a first plane;

a blade having a cutting edge at one end thereof in a second plane, said cutting edge extending forwardly from beneath said cap member;

said first and second planes intersecting at an angle of about 15° to about 25°;

a blade seat member located beneath said blade and including means extending forwardly from beneath said cutting edge for guarding skin surfaces from said cutting edge;

said skin guarding means including a plurality of forwardly extending elements, each one of said elements having a surface extending outwardly and downwardly in a plane parallel to said first plane; and said skin guarding means being oriented with respect to said cap upper surface to permit said cutting edge to contact skin surfaces only when said cap upper surface is in contact with such skin surfaces.

* * * * *